United States Patent [19]

Watanabe

[11] Patent Number: 4,798,921

[45] Date of Patent: Jan. 17, 1989

[54] VACUUM CIRCUIT BREAKER

[75] Inventor: Hideo Watanabe, Hitachi, Japan

[73] Assignee: Hitachi, Ltd., Tokyo, Japan

[21] Appl. No.: 199,711

[22] Filed: May 27, 1988

[30] Foreign Application Priority Data

Jun. 5, 1987 [JP] Japan ..... 62-139783

[51] Int. Cl.[4] ..... H01H 33/66

[52] U.S. Cl. ..... 200/144 B

[58] Field of Search ..... 200/144 B

[56] References Cited

U.S. PATENT DOCUMENTS 3,014,108 12/1961 Cobine et al. ..... 200/144 B 3,366,762 1/1968 Smith, Jr. ..... 200/144 B

*Primary Examiner*—Robert S. Macon

*Attorney, Agent, or Firm*—Antonelli, Terry & Wands

[57] ABSTRACT

Disclosed is a vacuum circuit breaker comprising a pair of rods disposed opposite to each other in a vacuum vessel, arc electrodes mounted on the confronting ends of the rods respectively, and a cup-shaped coil electrode mounted on one of the rods and surrounding the arc electrodes to form a first gap between the coil electrode and the other rod not having any coil electrode, the dimension of the first gap having selected to be smaller than that of a contact gap between the arc electrodes.

5 Claims, 1 Drawing Sheet

VACUUM CIRCUIT BREAKER

BACKGROUND OF THE INVENTION

This invention relates to a vacuum circuit breaker in which an improved coil electrode is provided for magnetically driving an arc generated during current interrupting operation.

An axial magnetic field type electrode is commonly employed in a vacuum circuit breaker designed for interrupting a large current. This axial magnetic field type electrode includes a coil electrode provided on an outer end of each of a pair of arc electrodes. When one of the arc electrodes is parted away from the other arc electrode to interrupt the flow of current, an arc jumps across the two arc electrodes. Arc current sustaining the arc flows through the coil electrodes into rods connected to the coil electrodes, and the current flowing through the coil electrodes produces a parallel (axial) magnetic field. By application of this parallel magnetic field to the arc, the arc is divided into numerous filament-like arcs and is finally extinguished. However, because the coil electrodes employed hitherto in such an electrode arrangement have a long current path which leads to a high electrical resistance, the coil electrodes generate a large quantity of heat even in the normal current conducting condition. Thus, the electrode arrangement is defective in that the larger the current conduction capacity, more heat is generated.

With a view to solve the above problem, JP-A No. 56-63723 and JP-A No. 56-118227 propose an improved axial magnetic field type electrode. According to the disclosures of these publications which solve the above problem, current is conducted through arc electrodes in the normal conducting condition, while current is conducted through a coil electrode only in the current interrupting condition.

That is, the proposed electrode arrangement includes a cup-shaped outer electrode mounted on a stationary rod, a movable rod disposed inside the outer electrode, a cup-shaped inner electrode mounted on the inner end of the movable rod, and a contact and a coil electrode mounted on one and the other end respectively of the inner electrode. An arc gap is formed between the inner electrode and the outer electrode. When the movable rod is moved toward the stationary rod to bring the contact into contact with the outer electrode thereby closing the circuit, current flows through the route of the movable rod - the inner electrode - the contact the outer electrode - the stationary rod in the normal current conducting condition. On the other hand, when the movable rod is moved in the direction opposite to that described above to break the circuit, current flows through the route of the stationary rod—the outer electrode—an arc jumping across the arc gap between the outer and inner electrodes—the inner electrode the coil electrode, and a parallel magnetic field produced by the coil electrode is applied to the arc in parallel to the arc.

However, because of the provision of the cup-shaped inner and outer electrode, the proposed electrode arrangement is defective in that its structure is complex.

SUMMARY OF THE INVENTION

It is an object of the present invention to provide a vacuum circuit breaker which is simple in structure and which includes a single coil electrode conducting current in the circuit breaking condition only.

The present invention which attains the above object provides a vacuum circuit breaker comprising a pair of rods disposed opposite to each other, arc electrodes mounted on the confronting ends of the rods respectively, a cup-shaped coil electrode mounted on one of the rods in a relation surrounding the arc electrode on that rod, and a first gap formed between the coil electrode and the arc electrode mounted on the other rod not having any coil electrode, the dimension of the first gap being selected to be smaller than that of a contact gap formed between the arc electrodes when one of the arc electrodes is moved away from the other to break a circuit.

In the present invention, the dimension of the first gap described above is selected to be smaller than the contact gap between the arc electrodes. Therefore, when one of the arc electrodes is moved away from the other arc electrode until the contact gap is reached, interrupting current flows from the coil electrode to the former arc electrode through the first gap to produce an arc jumping across the first gap. Since the direction of this arc is perpendicular with respect to the direction of a magnetic field produced by the coil electrode, the arc is magnetically driven in the first gap in the circumferential direction of the arc electrode by the magnetic field until finally the arc is extinguished. Thus, the structure of the vacuum circuit breaker of the present invention can be simplified because the coil electrode is provided on one of the rods only.

DESCRIPTION OF THE PREFERRED EMBODIMENTS

A preferred embodiment of the vacuum circuit breaker of the present invention will now be described in detail with reference to FIGS. 1 to 4.

Figure 1:
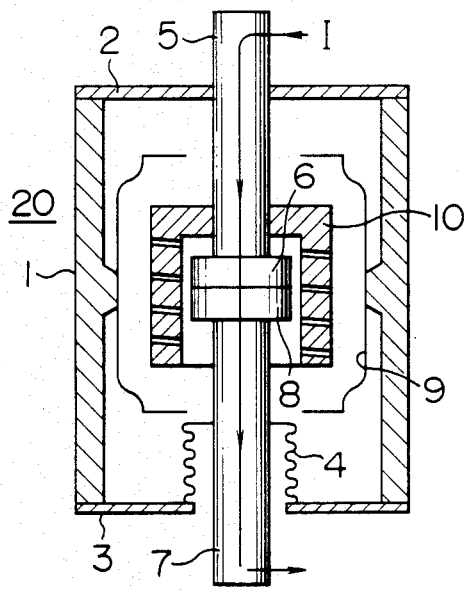
FIG. 1 is a sectional side elevation view of an embodiment of the vacuum circuit breaker of the present invention.

Referring to FIG. 1, the vacuum circuit breaker includes a vacuum vessel 20 which is composed of a cylindrical member 1 of an electrical insulator and a stationary-side end plate 2 and a movable-side end plate 3 fixed to both ends respectively of the cylindrical member 1. The end plate 3 has a central hole. A pair of a stationary rod 5 and a movable rod 7 are disposed opposite to each other in the vacuum vessel 20 so that the movable rod 7 is movable toward and away from the stationary rod 5. A stationary-side arc electrode 6 and a movable-side arc electrode 8 are mounted on the confronting ends of these rods 5 and 7 respectively. A bellows 4 is mounted between the movable rod 7 and the movable-side end plate 3 to permit axial movement of the movable rod 7. The axial movement of the movable rod 7 relative to the stationary rod 5 causes a corresponding movement of the movable-side arc electrode 8 toward and away from the stationary-side arc electrode 6, thereby closing and breaking a circuit. An intermediate shield 9 in thin sheet form is provided in the vacuum vessel 20. A coil electrode 10 is mounted on the stationary rod 5.

Figure 2:
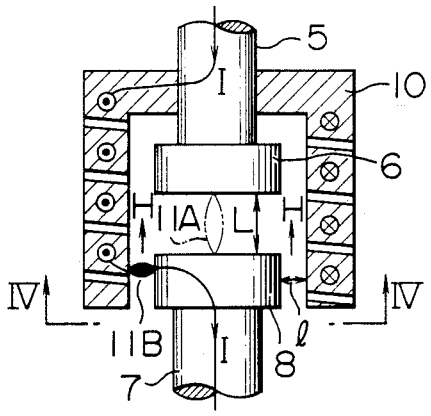
FIGS. 2 and 3 are sectional side elevation views of the coil electrode and associated parts shown in FIG. 1.

The coil electrode 10 is shaped in the form of a cup so as to surround both the stationary-side arc electrode 6 and the movable-side arc electrode 8. The coil electrode 10 is fixed at the top of its cup shape to the stationary rod 5 by hard soldering, and the movable-side arc electrode 8 is concentrically disposed in the internal space of the cup-shaped coil electrode 10. In the open or circuit breaking position of the vacuum circuit breaker, an axial contact gap L as shown in FIG. 2 is formed between the stationary-side arc electrode 6 and the movable-side arc electrode 8. As also shown in FIG. 2, a first gap l is formed between the coil electrode 10 and the movable-side arc electrode 8 located opposite to the coil electrode 10. The direction of this first gap l is perpendicular with respect to that of the contact gap L, and the dimensions of these gaps L and l are selected so as to satisfy the relation L>l.

Current I flowing into, for example, the stationary rod 5 in the vacuum circuit breaker passes through the stationary-side arc electrode 6, movable-side arc electrode 8 and movable rod 7 to flow out into an external conductor connected to the movable rod 7.

When a circuit breaking signal is applied to the vacuum circuit breaker while the current I is flowing through the path described above, the movable rod 7 is urged downward in FIG. 1 by an actuating mechanism (not shown), and an arc 11A as shown in FIG. 2 starts to jump across a gap formed between the movable-side arc electrode 8 and the stationary-side arc electrode 6. When the movable-side arc electrode 8 is further urged away from the stationary-side arc electrode 6, the arc 11A is finally extinguished. The gap formed when the arc 11A is finally extinguished is the contact gap L.

Figure 3:
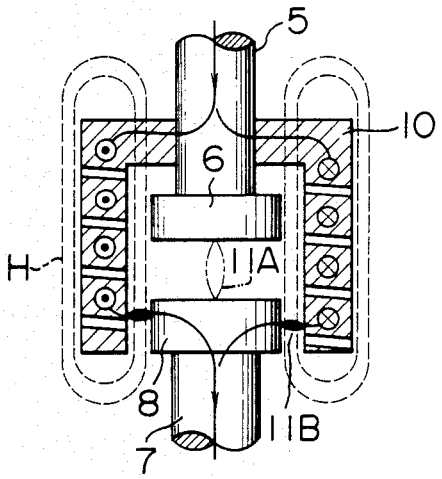
Figure 4:
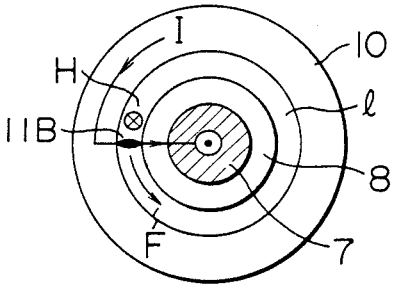
FIG. 4 is a sectional view taken along the line IV—IV in FIG. 2.

The first gap l is shorter than the contact gap L. Therefore, when the contact gap L is reached, the interrupting current I flows from the coil electrode 10 into the movable-side arc electrode 8 as shown by the arrow in FIG. 2, and an arc 11B jumps across the first gap l. The current I flowing through the coil electrode 10 produces a magnetic field H having a direction perpendicular with respect to that of the arc 11B as shown in FIG. 3. Consequently, an electromagnetic force F as shown in FIG. 4 acts on the arc 11B to extinguish the arc 11B while magnetically driving the arc 11B in the circumferential direction of the movable-side arc electrode 8 in the first gap l. Therefore, the arc can be extinguished by merely mounting the coil electrode 10 on the stationary rod 5, and the structure of the vacuum circuit breaker can be simplified. Further, the arc generated as a result of the circuit breaking operation is divided into the arc 11A jumping across the gap between the stationary-side arc electrode 6 and the associated major face of the movable-side arc electrode 8 and the arc 11B jumping across the gap between the coil electrode 10 and the associated side face of the movable-side arc electrode 8. Therefore, the possibility of damage to the movable-side arc electrode 8 due to fusion by the heat of the arc is decreased to extend the useful service life of the arc electrode 8.

Further, the axial movement of the movable-side arc electrode 8 is limited to the range of the internal space of the coil electrode 10 so that the arc electrode 8 may not protrude from the open end of the coil electrode 10. Therefore, even if the arc 11B magnetically driven along the circumference of the movable-side arc electrode 8 in the first gap l may deviate from its orbit and run outward from within the first gap (, the arc 11B would not impinge against the intermediate shield 9 by being obstructed by the coil electrode 10, so that undesirable damage to the intermediate shield 9 due to fusion by the heat of the arc can be prevented. That is, the movable-side arc electrode 8 is preferably disposed in the internal space of the coil electrode 10 in such a relation that the outer end of the movable-side arc electrode 8 may not externally protrude beyond the open end of the coil electrode 10 so as to prevent escapement of the arc 11B toward the intermediate shield 9 from the first gap l. Further, because the coil electrode 10 is provided on the stationary rod 5, the size of the actuating mechanism (not shown) for actuating the movable rod 7 can be decreased.

A modification of the vacuum circuit breaker of the present invention includes a cup-shaped member of an electrical insulator, for example, a ceramic material. The stationary rod is connected at its inner end to the closed end of the cup-shaped member, and a current path associated with the movable-side arc electrode mounted on the inner end of the movable rod is formed on the inner face of the open end of the cup-shaped member. A coil wound around the cup-shaped member is connected at one end thereof to the current path and at the other end thereof to the stationary rod. In this modification, no short circuit occurs between the turns of the coil even when metal vapor generated from the electrodes due to repeated circuit closing and breaking operations may deposit on the inner face of the cup-shaped member.

It will be understood from the foregoing description that, in the vacuum circuit breaker according to the present invention, a single coil electrode is provided on one of a pair of rods, and interrupting current flows through this coil electrode in the circuit breaking operation only. Therefore, the structure of the vacuum circuit breaker can be simplified.

I claim:

1. A vacuum circuit breaker comprising a vacuum vessel, a pair of arc electrodes disposed opposite to each other in said vacuum vessel, a pair of rods supporting said arc electrodes thereon respectively and extending to the outside of said vacuum vessel, and means for moving one of said rods relative to the other rod to move one of said arc electrodes toward and away from the other arc electrode thereby closing and breaking a circuit, said vacuum circuit breaker further comprising a cup-shaped coil electrode mounted on one of said rods and surrounding said arc electrodes to form a gap between said coil electrode and said arc electrode mounted on the other rod not having any coil electrode, the dimension of said gap being selected to be smaller than that of a contact gap formed between said arc electrodes when said arc electrodes are moved away from each other to break the circuit.

2. A vacuum circuit breaker comprising a vacuum vessel, a pair of arc electrodes disposed opposite to each other in said vacuum vessel, a pair of rods supporting said arc electrodes thereon respectively and extending to the outside of said vacuum vessel, and means for moving one of said rods relative to the other rod to move one of said arc electrodes toward and away from the other arc electrode thereby closing and breaking a circuit, said vacuum circuit breaker further comprising a cup-shaped coil electrode mounted on one of said rods and surrounding said arc electrodes, said coil electrode providing a path of interrupting current from said coil electrode to said arc electrode mounted on said rod not having any coil electrode when one of said arc electrodes is moved away from the other arc electrode to form a contact gap therebetween.

3. A vacuum circuit breaker comprising a vacuum vessel, a pair of arc electrodes disposed opposite to each other in said vacuum vessel, a pair of a stationary rod and a movable rod supporting said arc electrodes thereon respectively and extending to the outside of said vacuum vessel, and means for moving said movable rod relative to said stationary rod to move said arc electrode mounted on said movable rod toward and away from said arc electrode mounted on said stationary rod thereby closing and breaking a circuit, said vacuum circuit breaker comprising a cup-shaped coil electrode mounted on said movable rod and surrounding said arc electrodes to form a gap between said coil electrode and said arc electrode mounted on said movable rod, the dimension of said gap being selected to be smaller than that of a contact gap formed between said arc electrodes when said arc electrode mounted on said movable rod is moved away from said arc electrode mounted on said stationary rod to break the circuit.

4. A vacuum circuit breaker comprising a vacuum vessel, a pair of arc electrodes disposed opposite to each other in said vacuum vessel, a pair of a stationary rod and a movable rod supporting said arc electrodes thereon respectively and extending to the outside of said vacuum vessel, and means for moving said movable rod relative to said stationary rod to move said arc electrode mounted on said movable rod toward and away from said arc electrode mounted on said stationary rod thereby closing and breaking a circuit, said vacuum circuit breaker further comprising a cup-shaped coil electrode mounted on said stationary rod and surrounding said arc electrodes, said coil electrode providing a path of interrupting current from said coil electrode to said arc electrode mounted on said movable rod when said arc electrode mounted on said movable rod is moved away from said arc electrode mounted on said stationary rod to form a contact gap therebetween.

5. A vacuum circuit breaker comprising a vacuum vessel, a pair of arc electrodes disposed opposite to each other in said vacuum vessel, a pair of a stationary rod and a movable rod supporting said arc electrodes thereon respectively and extending to the outside of said vacuum vessel, and means for moving said movable rod relative to said stationary rod to move said arc electrode mounted on said movable rod toward and away from said arc electrode mounted on said stationary rod thereby closing and breaking a circuit, said vacuum circuit breaker further comprising a coil electrode mounted on said stationary rod to provide a path of interrupting current only when said arc electrode mounted on said movable rod is moved away from said arc electrode mounted on said stationary rod to break the circuit, said coil electrode including a cup-shaped member of an electrical insulator surrounding said arc electrode mounted on said stationary rod, a current path formed on the inner face of the open end of said cup-shaped member to be opposed through a gap by said arc electrode mounted on said movable rod, and a coil wound around the outer peripheral face of said cup-shaped member and connected at one end thereof to said current path and at the other end thereof to said stationary rod.

* * * * *